US009510674B1

(12) United States Patent
Moore

(10) Patent No.: US 9,510,674 B1
(45) Date of Patent: Dec. 6, 2016

(54) INSTRUMENT MUSIC LYRE

(71) Applicant: N. Lee Ann Moore, Hanahan, SC (US)

(72) Inventor: N. Lee Ann Moore, Hanahan, SC (US)

( * ) Notice: Subject to any disclaimer, the term of this patent is extended or adjusted under 35 U.S.C. 154(b) by 0 days.

(21) Appl. No.: 14/955,217

(22) Filed: Dec. 1, 2015

Related U.S. Application Data

(60) Provisional application No. 62/085,713, filed on Dec. 1, 2014.

(51) Int. Cl.
*G10G 5/00* (2006.01)
*A47B 23/00* (2006.01)

(52) U.S. Cl.
CPC ..... *A47B 23/004* (2013.01)

(58) Field of Classification Search
CPC ..... A47B 23/004; Y10T 24/203; G10D 9/00
See application file for complete search history.

(56) References Cited

U.S. PATENT DOCUMENTS 1,376,780 A 5/1921 Reid
1,539,042 A * 5/1925 Dennis ..... A47B 23/004 248/443
1,897,799 A 2/1933 Haight
2,241,319 A 5/1941 Roseberry
2,827,732 A 3/1958 Schumaker
3,437,002 A * 4/1969 Defauw ..... A47B 23/004 84/329
3,539,143 A * 11/1970 Johnston ..... A47B 23/004 24/67.5
3,543,633 A 12/1970 Batten
D255,459 S * 6/1980 Corder ..... A47B 23/004 D17/10
5,297,768 A 3/1994 Denton
5,579,969 A * 12/1996 Brandell ..... A45F 3/50 224/277
7,404,534 B1 * 7/2008 Hajianpour ..... A45F 5/02 224/419

* cited by examiner

*Primary Examiner* — Amy Sterling
(74) *Attorney, Agent, or Firm* — Robert C. Montgomery; Montgomery Patent & Design LLC

(57) ABSTRACT

A lyre for retaining musical copy or other leaf-style items is particularly suited for marching band brass instruments. The configuration incorporates the use of a saddle which is selectively positioned on the instrument to permit a user to read the copy in a hands-free scenario. Straps are employed to cinch the saddle into place on the instrument while a lyre extends perpendicularly from the saddle. This particular lyre is designed to accommodate a larger amount of copy.

14 Claims, 3 Drawing Sheets

INSTRUMENT MUSIC LYRE

RELATED APPLICATIONS

The present invention is a continuation of, was first described in, and claims the benefit of U.S. Provisional Application No. 62/085,713, filed Dec. 1, 2014, the entire disclosures of which are incorporated herein by reference.

FIELD OF THE INVENTION

The present invention relates generally to a lyre for retaining musical copy or other leaf-style items particularly suited for marching band brass instruments.

BACKGROUND OF THE INVENTION

The marching band is a time-honored and highly respected aspect of high-schools and colleges around the country. Most commonly seen at half time shows during football games, a marching band show provides the performers the opportunity to not only show off their musical talents, but also their synchronized chorographical skills. Many performers, especially those who play brass instruments, hold their music in a lyre or flip folder at the distal end of their instrument. As many of the band's movements are fast and even "vigorous", a common problem is that the sheet music holder tends to twist, turn, or even break and fall off. Accordingly, there exists a need for a means by which sheet music can be easily held on marching band instruments without the disadvantages as described above. The use of the music lyre enables marching band performers the ability to see their sheet music without worry at all times in a manner which is not only quick, easy, and effective, but non-disruptive as well.

SUMMARY OF THE INVENTION

It is therefore an object of the present invention to provide such a means to attach a lyre to an instrument in a marching band, the lyre capable of holding a plurality of leaves of musical copy and retaining a displayed individual leaf while the hands are otherwise engaged in performing the instrument. Such a lyre includes a saddle plate capable of being removably attached to the instrument, and a musical holder assembly capable of rotational attachment to the saddle plate. The saddle plate in one (1) embodiment is shaped to conform to the outer profile of the instrument. In another embodiment, the saddle plate is made of a material capable of being conformed to match the outer profile of the instrument.

Another object of the present invention is to provide a pair of adjustable straps that are capable of routing through slots on the saddle plate and wrapping around the instrument. In a preferred embodiment, the straps have a material that provides a frictional attachment to the instrument and limits the amount of movement of the lyre on the instrument.

Another object is to provide a layer of padding on the side of the saddle plate that abuts against the instrument Yet another object is to provide such a holder assembly to be a generally "L"-shaped holder, having a planar rear panel and a planar horizontal panel.

Another object is to provide a means to retain the plurality of individual sheets of copy on the rear panel. This can be accomplished with rings routed through apertures near the top of the rear panel and through each of the plurality of leaves of copy. Another embodiment also includes a stay affixed to the rear surface of the rear panel. The stay is biased against the rear panel and is capable of retaining the plurality of leaves of copy in a stacked arrangement.

Yet another object of the apparatus is to provide the rotational attachment of the holder assembly to the saddle plate. A holder mount in located on an upper surface of the saddle plate. A saddle mount is located on the bottom surface of the lower plate of the holder assembly and has a plurality of detents, each capable of aligning with a plurality of protrusions of the holder mount. A fastener is routed through both the saddle mount and holder mount.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
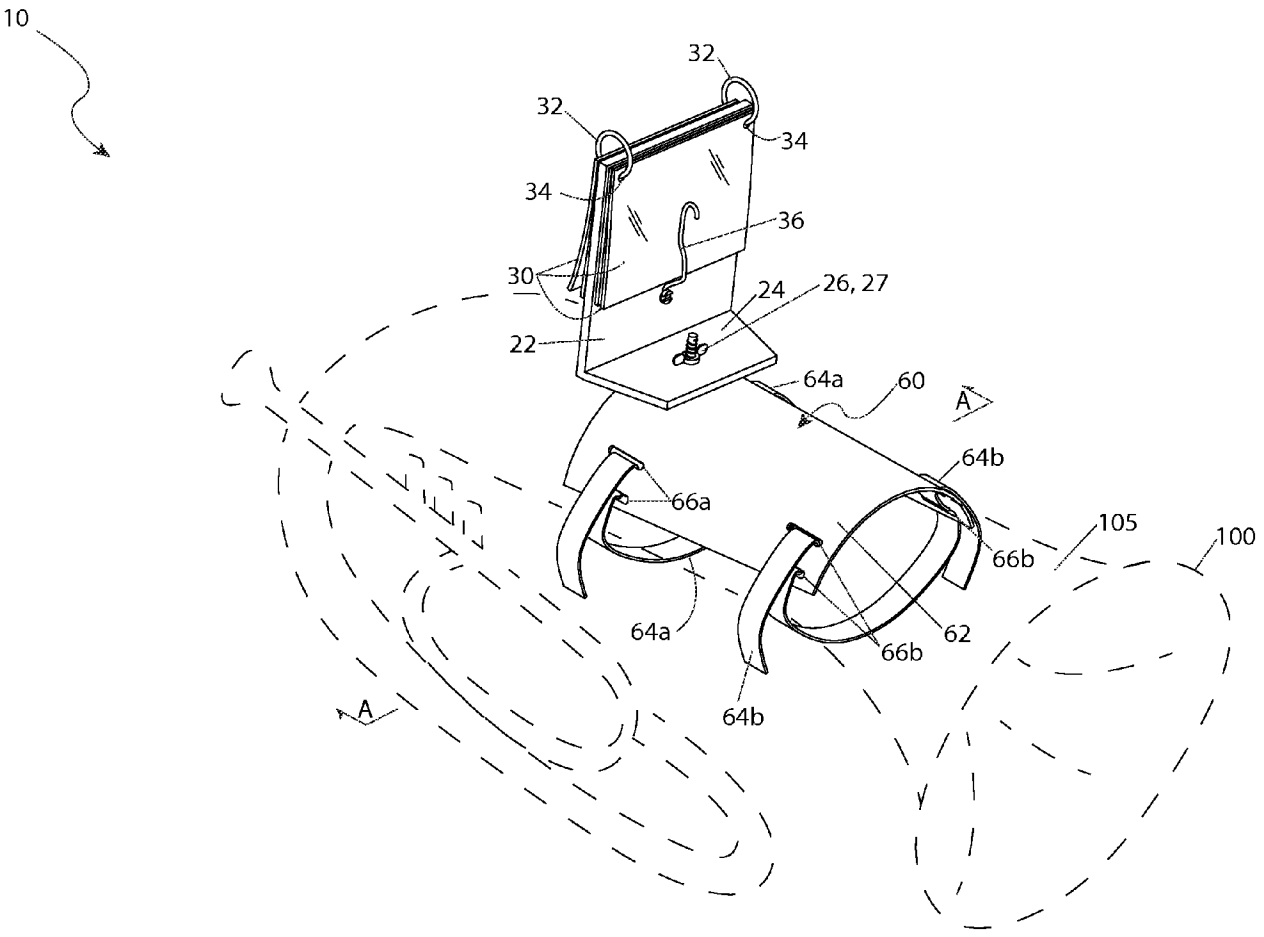
FIG. 1 is a perspective environmental view of a brass instrument music lyre 10, according to a preferred embodiment of the present invention.

10 brass instrument music lyre
20 holder assembly
22 rear panel
24 lower panel
25 fastener aperture
26 stud
27 wing nut
30 copy
32 ring
34 ring aperture
36 stay
38 upper mounting plate
40 detent
60 saddle assembly
62 saddle plate
64*a* first strap
64*b* second strap
66 strap aperture
67 hook-and-loop fastener
68 lower mounting plate
70 protuberance
76 padding
80 fastener
100 instrument
105 bell/body

DETAILED DESCRIPTION OF THE PREFERRED EMBODIMENT

Figure 2:
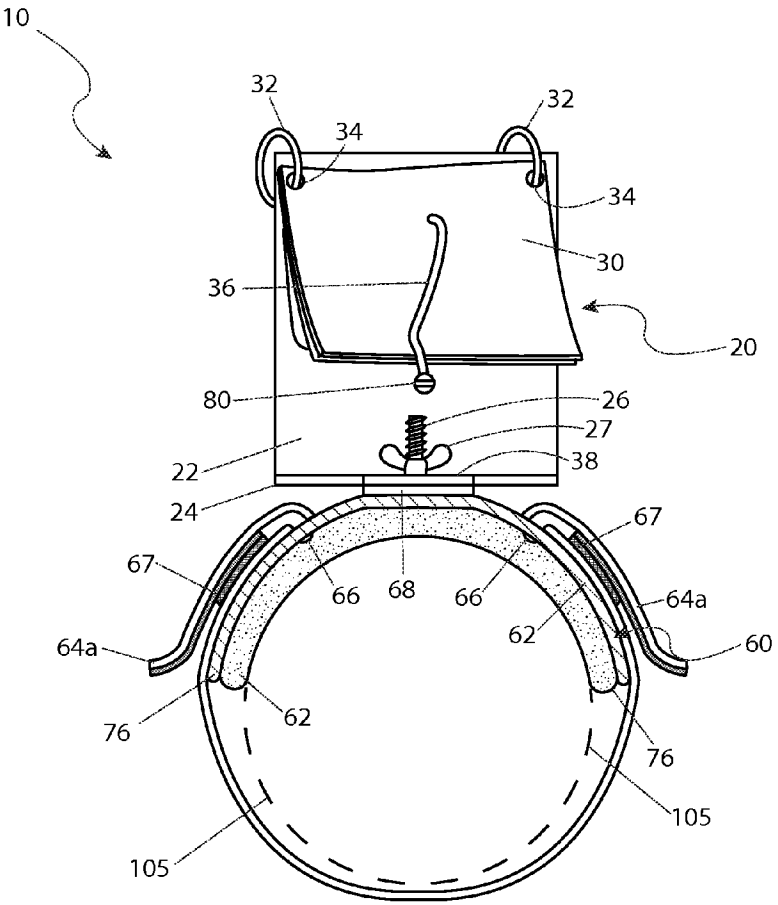
FIG. 2 is a sectional view of the lyre 10 taken along section line A-A (see FIG. 1), according to a preferred embodiment of the present invention; and, FIG. 3 is a close-up exploded view of mounting plate portions 38, 68 of the lyre 10, according to a preferred embodiment of the present invention.
Figure 3:
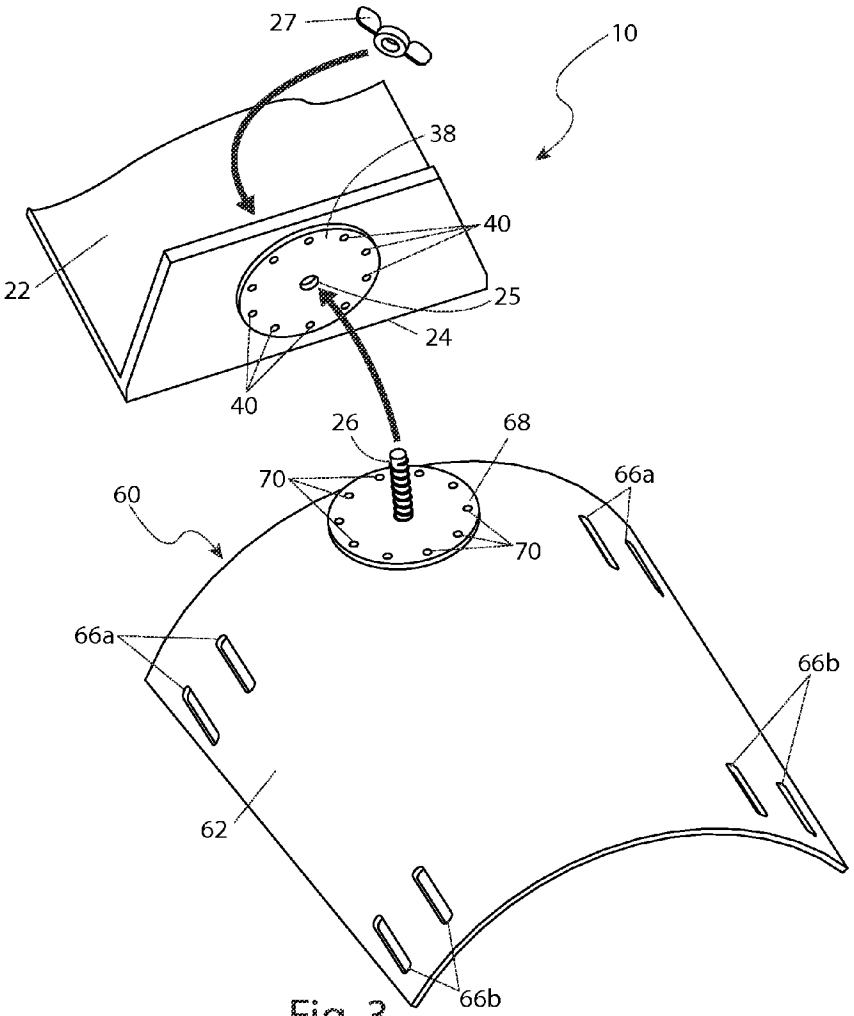

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a brass instrument music lyre (herein described as the "apparatus") 10, which provides a means for removable attachment preferably to one (1) of a variety of brass musical instruments 100. The lyre 10 is capable of retaining a plurality of sheets of copy 30 therein. Such copy 30 is typically music copy that is played by the user of the instrument 100. The apparatus 10 is envisioned to be especially useful for use by individuals who participate in marching bands.

Referring now to FIG. 1, a perspective environmental view of the apparatus 10, according to the preferred embodiment of the present invention, is disclosed. The apparatus 10 includes a music holder assembly 20 and a saddle assembly 60 which secures the music holder assembly 20 to a bell/body portion 105 of a preferred brass instrument 100.

The music holder assembly 20 provides a means of positioning and securing a plurality of individual sheets of copy 30 via an "L"-shaped structure being rotatingly affixed to a saddle plate portion 62 of the saddle assembly 60 via respective upper mounting plate 38 and lower mounting plate 68 portions, being affixed to each other using a threaded stud 26 and a wing nut 27. The holder assembly 20 is envisioned to be made using a rugged weather-resistant plastic or metal planar material and includes a vertical rear panel 22 and a horizontal lower panel 24. The lower panel 24 may taper to a smaller width from the edge attached to the rear panel 22 to the opposing edge. The rear panel 22 provides features and attaching means to position a plurality of sheets of copy 30, thereby allowing portions of the copy 30 to be flipped over to view a particular copy portion 30. The saddle assembly 60 provides rotating attachment of the holder assembly 20 allowing the holder assembly 20 and the affixed copy 30 to be viewed in a "straight on" manner, or at an angle to the user, or may even be rotated one-hundred eighty degrees (180°) to allow access to second side portions of the copy 30 (also see FIG. 3).

The saddle assembly 60 includes an arcuate saddle plate 62 shaped so as to conform to profile portions of the bell/body 105 of conventional instruments 100. Alternately, the saddle plate 62 is a semi-rigid material capable of being shaped to conform to profile portions of the bell/body 105 of the instrument 100. The saddle plate 62 includes a first strap 64*a* and a second strap 64*b* which provide secure attachment of the apparatus 10 to the instrument 100. The length of each strap 64*a*, 64*b* is easily adjustable to fit different sizes and types of instruments 100, and can be installed or removed quickly without tools. The straps 64*a*, 64*b* are to be fabricated using a material which provides a sufficient width so as to provide a friction against the instrument 100 to stabilize the apparatus 10 upon the instrument 100.

Referring now to FIG. 2, a sectional view of the apparatus 10, according to the preferred embodiment of the present invention, is disclosed. The rear panel 22 includes a pair of rings 32 and corresponding ring apertures 34 formed therethrough. The rings 32 in turn pass through holes punched in the copy 30 allowing the copy 30 to be quickly flipped over by the user. Furthermore, it is envisioned that the copy 30 may be arranged in a back-to-back manner having pairs which are either laminated using clear plastic, or contained in clear plastic sleeves to maximize a number of copy items 30 present upon the holder assembly 20.

The saddle plate 62 is envisioned to include a layer of padding 76 affixed to a bottom surface thereof using adhesives or an equivalent bonding method. It is envisioned that various models of the apparatus 10 would offer custom shaped padding 76 so as to match the contours of a particular instrument 100 onto which the apparatus 10 is applied.

The rear panel portion 22 of the holder assembly 20 is envisioned to include at least one (1) stay 36 which provides a means to clamp and stabilize the position of the copy 30 even during windy conditions in a stacked arrangement. An embodiment of the stay 36 is illustrated here comprising of a formed length of resilient wire being affixed to the rear panel 22 using a fastener 80 such as a screw, rivet, or the like.

The strap portions 64*a*, 64*b* of the saddle assembly 20 provide a length-adjustable and cinching means around the bell/body portion 105 of the brass instrument 100. The straps 64*a*, 64*b* are wrapped around the bell/body portion 105 in a parallel manner to each other, and each end portion of each strap 64*a*, 64*b* is looped through respective pairs of strap aperture portions 66*a*, 66*b* formed through opposing edge portions of the saddle plate 62. Each end portion of each strap 64*a*, 64*b* is looped through respective strap apertures 66*a*, 66*b* so as to reverse its direction, and then is secured to itself via integral sewn-in hook-and-loop fastener portions 67 such as Velcro being positioned upon the mating surfaces.

Referring now to FIG. 3, a close-up exploded view of mounting plate portions 38, 68 of the apparatus 10, according to a preferred embodiment of the present invention, is disclosed. The apparatus 10 provides angularly selective attachment of the holder assembly 20 to the saddle assembly 60 via respective upper mounting plate 38 and lower mounting plate 68 portions. The upper mounting plate 38 is envisioned to be integral to the lower panel portion 24 and includes a central fastener aperture 25 and a plurality of equally-spaced circular detents 40 arranged in a circular pattern along a bottom surface of the lower panel 24. Correspondingly, the saddle plate 62 includes a central and upwardly directed threaded stud 26 and a plurality of equally-spaced protuberances 70 arranged in a circular pattern along a top surface of the lower mounting plate 68. The upper 38 and lower 68 mounting plates are attached by inserting the stud 26 up through the fastener aperture 25 and installing the wing nut 27 upon the stud 26. The detents 40 and the protuberances 70 are envisioned to have respective female and male half-sphere shapes, and are positioned and sized such that they insert into each other as the mounting plates contact each other.

To position and secure the holder assembly 20 at a desired angle, a user loosens the wing nut 27 along the stud 26, lifts and rotates the holder assembly 20 to a desired orientation, and lowers the holder assembly 20 to engage the detents 40 and protuberances 70. The wing nut 27 is then tightened to retain the holder assembly 20 in position.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: procuring a model of the apparatus 10 which provides a saddle assembly 60 which provides a suitable fit onto an intended instrument 100; positioning the saddle plate 62 upon the bell/body portion 105 of the instrument 100; wrapping a first strap portion 64*a* around the bell/body 105; looping end portions of the first strap 64*a* through respective pairs of strap apertures 66*a*, 66*b* in the saddle plate 62; extending the ends of the strap 64*a* back over themselves; cinching and fastening the ends of the strap 64*a* to themselves tightly around the instrument 100 by connecting the sewn-in hook-and-loop fastener portions 67; repeating the above steps for the second strap 64*b*; installing the holder assembly 20 onto the saddle assembly 60, if not previously installed, by inserting the stud portion 26 of the lower mounting plate 68 up through the fastener aperture portion 25 of the upper mounting plate 38; installing the wing nut 27 upon the stud 26 loosely; lifting and rotating the holder assembly 20 to a desired orientation and corresponding viewing angle; lowering the holder assembly 20 to engage the detents 40 and protuberances 70; securing the position of the holder assembly 20 by tightening the wing nut 27; preparing a plurality of sheets of copy 30 in a back-to-back manner; containing the copy 30 by either laminating or inserting the pairs of copy 30 in clear plastic sleeves; punching holes through the copy 30; mounting a desired number of sheets of copy 30 onto the ring portions 32 of the rear panel 22; and, securing the copy 30 to the rear panel 22 using the wire stay 36, as needed.

The apparatus 10 may be used by a marching band members or similar performers using brass instruments 100 to position a plurality of sheets of copy 30 in a hands-free manner. During performances, an observed page of copy 30 may be changed when desired by either flipping one (1) or more sheets over a top portion of the rear plate 22, or by loosening the wing nut 27 and rotating the holder assembly 20 one-hundred eighty degrees) (180°) to access additional sheets of copy 30.

Alternate embodiments of the apparatus 10 are envisioned to provide differently sized and shaped saddle plates 62 and corresponding padding portions 76 designed to conform to exterior contours of different brass instruments 100 from a trumpet to a sousaphone, so as to position the apparatus 10 properly and securely.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A music lyre, comprising:

a saddle assembly, comprising:

a saddle plate having a general shape corresponding to an outer profile of an instrument;

a holder mount located on a first surface of said saddle plate;

a padding layer coextensive with a second surface of said saddle plate, said second surface adapted to contact said instrument when said saddle plate is placed thereon;

at least one removable attachment means for attaching said saddle plate to said instrument; and, a pair of attachment slots on either side of a longitudinal centerline for receipt of each removable attachment means; and, a generally L-shaped holder assembly rotatably attached to said holder mount with a saddle mount, having a rear panel and a lower panel, said lower panel having a first edge coextensive with and extending perpendicularly away from a first edge of said rear panel, and said lower panel tapers in width from said lower panel first edge to an opposing lower panel second edge;

wherein said saddle mount is located on a bottom surface of said lower panel;

wherein a plurality of individual leaves of copy is capable of being affixed to and retained by said rear panel, thereby enabling individual leaves to be viewed independently; and, wherein said holder assembly is capable of rotational positioning relative to said saddle assembly.

2. The lyre of claim 1, wherein each removable attachment means is a width adjustable strap.

3. The lyre of claim 2, wherein said strap comprises a material capable of providing a friction stability to said instrument.

4. The lyre of claim 1, wherein said rear panel and said lower panel are planar.

5. The lyre of claim 1, further comprising:

a pair of apertures, each located equidistant from a vertical center axis longitudinally bisecting said rear panel adjacent a second edge opposite said rear panel first edge; and, a pair of rings, each passing through an individual aperture, each ring capable of securing to said plurality of individual leaves of copy.

6. The lyre of claim 1, further comprising a stay having a first end affixed to a first surface of said rear panel, superjacent from said lower panel;

wherein a second end of said stay is biased towards said rear panel first surface; and, wherein said stay is configured to retain said plurality of individual leaves of copy in a stacked arrangement.

7. The lyre of claim 1, wherein:

said holder mount comprises a first aperture located in a center thereof and a plurality of protrusions arranged in a first circular configuration adjacent an edge thereof;

said saddle mount comprises a second aperture located in a center thereof and a plurality of detents arranged in a second circular configuration adjacent an edge thereof;

wherein said plurality of protrusions is aligned with said plurality of detents when said first and second apertures are aligned; and, wherein a fastener fastens said holder mount to said saddle mount.

8. A music lyre, comprising:

a saddle assembly, comprising:

a saddle plate having a material capable of conforming to an outer profile of an instrument;

a holder mount located on a first surface of said saddle plate;

a padding layer coextensive with a second surface of said saddle plate, said second surface adapted to contact said instrument when said saddle plate is placed thereon;

at least one removable attachment means for attaching said saddle plate to said instrument; and, a pair of attachment slots on either side of a longitudinal centerline for receipt of each removable attachment means; and, a generally L-shaped holder assembly rotatably attached to said holder mount with a saddle mount, having a rear panel and a lower panel, said lower panel having a first edge coextensive with and extending perpendicularly away from a first edge of said rear panel, and said lower panel tapers in width from said lower panel first edge to an opposing lower panel second edge;

wherein said saddle mount is located on a bottom surface of said lower panel;

wherein a plurality of individual leaves of copy is capable of being affixed to and retained by said rear panel, thereby enabling individual leaves to be viewed independently; and, wherein said holder assembly is capable of rotational positioning relative to said saddle assembly.

9. The lyre of claim 8, wherein each removable attachment means is a width adjustable strap.

10. The lyre of claim 9, wherein said strap comprises a material capable of providing a friction stability to said instrument.

11. The lyre of claim 8, wherein said rear panel and said lower panel are planar.

12. The lyre of claim 8, further comprising:

a pair of apertures, each located equidistant from a vertical center axis longitudinally bisecting said rear panel adjacent a second edge opposite said rear panel first edge; and, a pair of rings, each passing through an individual aperture, each ring capable of securing to said plurality of individual leaves of copy.

13. The lyre of claim 8, further comprising a stay having a first end affixed to a first surface of said rear panel, superjacent from said lower panel;

wherein a second end of said stay is biased towards said rear panel first surface; and, wherein said stay is configured to retain said plurality of individual leaves of copy in a stacked arrangement.

14. The lyre of claim 8, wherein:

said holder mount comprises a first aperture located in a center thereof and a plurality of protrusions arranged in a first circular configuration adjacent an edge thereof;

said saddle mount comprises a second aperture located in a center thereof and a plurality of detents arranged in a second circular configuration adjacent an edge thereof;

wherein said plurality of protrusions is aligned with said plurality of detents when said first and second apertures are aligned; and, wherein a fastener fastens said holder mount to said saddle mount.

* * * * *